US008314719B2

(12) United States Patent
Grothe

(10) Patent No.: US 8,314,719 B2
(45) Date of Patent: Nov. 20, 2012

(54) METHOD AND SYSTEM FOR MANAGING TRAFFIC ADVISORY INFORMATION

(75) Inventor: Steven Paul Grothe, Cave Creek, AZ (US)

(73) Assignee: Honeywell International Inc., Morristown, NJ (US)

( * ) Notice: Subject to any disclaimer, the term of this patent is extended or adjusted under 35 U.S.C. 154(b) by 562 days.

(21) Appl. No.: 12/340,117

(22) Filed: Dec. 19, 2008

(65) Prior Publication Data

US 2010/0156673 A1 Jun. 24, 2010

(51) Int. Cl.
*G08G 5/04* (2006.01)

(52) U.S. Cl. ..... 340/961; 340/963; 340/970; 340/973; 340/974; 340/975; 340/978; 340/979; 701/3; 701/4; 701/5; 701/120

(58) Field of Classification Search ..... 340/961, 340/945

See application file for complete search history.

(56) References Cited

U.S. PATENT DOCUMENTS 5,181,027 A * 1/1993 Shafer ..... 340/961
6,271,768 B1 8/2001 Frazier, Jr. et al.
7,308,343 B1 12/2007 Horvath et al.
2002/0188398 A1 12/2002 Watson
2004/0174295 A1 9/2004 Stayton et al.
2007/0038339 A1 * 2/2007 Shirley et al. ..... 701/14
2007/0200731 A1 8/2007 Winkler et al.

FOREIGN PATENT DOCUMENTS

FR 2897975 A1 8/2007
WO 0041154 A1 7/2000
WO 02068905 A2 9/2002

OTHER PUBLICATIONS

EP Search Report, EP 09177961.1 dated Mar. 19, 2010.
European Search Report dated May 7, 2010, for Application No. 09177961.

* cited by examiner

*Primary Examiner* — Sara Samson
(74) *Attorney, Agent, or Firm* — Ingrassia Fisher & Lorenz, P.C.

(57) ABSTRACT

Methods and systems for operating an avionics system are provided. A set of data that is representative of traffic advisory information is received. A visual indicator is displayed to a user based on the set of data that is representative of the traffic advisory information. The traffic advisory information may be received by a user through a receiver and manually entered into an interface for viewing. Alternatively, the avionics system may automatically generate the visual indicator based on the traffic advisory information.

20 Claims, 6 Drawing Sheets

METHOD AND SYSTEM FOR MANAGING TRAFFIC ADVISORY INFORMATION

TECHNICAL FIELD

The present invention generally relates to head-up displays (HUDs), and more particularly relates to methods and systems for operating near-to-eye (NTE) displays.

BACKGROUND

Flight crew personnel are often provided with traffic advisories from air traffic controllers (ATC) regarding other aircraft in the vicinity so that an appropriate distance may be maintained between the aircraft. The traffic advisories are usually based on radar observations made by the ATC.

The information is provided to the flight crew verbally over the communications radio and indicates the relative position of another aircraft by including an "o'clock" lateral segment, the distance between the two aircraft, the direction of flight of the other aircraft, the altitude and the state of altitude change of the other aircraft, and the type of other aircraft. The flight crew is then expected to visually locate the other aircraft and inform the ATC if and when visual contact is made. Depending on the conditions, visually acquiring the other aircraft may be difficult and time consuming, and may distract the flight crew from other tasks. As a result, often the traffic is never seen by the flight crew.

Accordingly, it is desirable to provide a method and system for operating an avionics system that provides a visual indicator to the user based on traffic advisory information. Furthermore, other desirable features and characteristics of the present invention will become apparent from the subsequent detailed description of the invention and the appended claims, taken in conjunction with the accompanying drawings and this background of the invention.

BRIEF SUMMARY

In one embodiment, a method for operating an avionics system is provided. A set of data that is representative of traffic advisory information is received. A visual indicator is displayed to a user based on the set of data that is representative of the traffic advisory information.

In another embodiment, an avionics system is provided. The avionics system includes a receiver configured to receive data representative of traffic advisory information, the traffic advisory information being representative of a position of a traffic aircraft, a velocity of a traffic aircraft, or a combination thereof, the traffic aircraft being an aircraft other than a primary aircraft in which the avionics system is installed, a visual indicator generator configured to display a visual indicator to a user, and a processing system in operable communication with the receiver and the visual indicator generator. The processing system is configured to cause the visual indicator generator to display a visual indicator to the user based on a set of data that is representative of the traffic advisory information received by the receiver.

In a further embodiment, an avionics system is provided. The avionics system includes a user input device configured to receive manual user input from a user, and a visual indicator generator configured to display a plurality of visual indicators based on the manual user input from the user, the visual indicators indicating a position of a traffic aircraft, a velocity of a traffic aircraft, or a combination thereof, the traffic aircraft being an aircraft other than a primary aircraft in which the avionics system is installed.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-6 are merely illustrative and may not be drawn to scale.

FIG. 1 to FIG. 6 illustrates methods and systems for managing traffic advisory information, or for operating an avionics system based on traffic advisory information. In one embodiment, a set of data that is representative of traffic advisory information is received. A visual indicator is displayed to a user based on the set of data that is representative of the traffic advisory information. The traffic advisory information may be received by a user through a receiver and manually entered into an interface for viewing. In another embodiment, the avionics system automatically generates the visual indicator based on the traffic advisory information.

Figure 1:
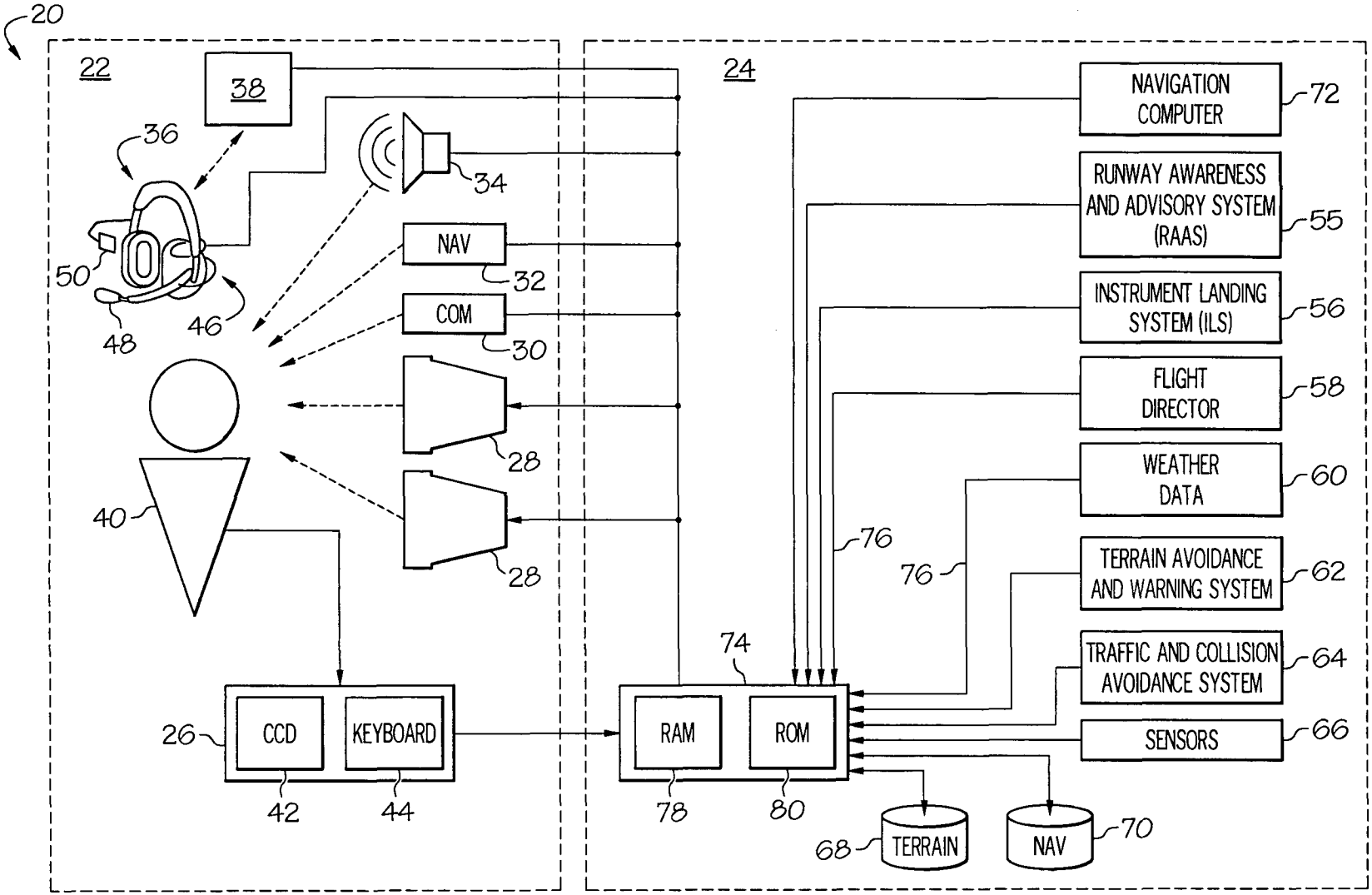
FIG. 1 is a schematic block diagram of an aircraft, according to one embodiment of the present invention.

FIG. 1 schematically illustrates a vehicle 20, such as an aircraft, according to one embodiment of the present invention. The vehicle (or aircraft) 20 may be, in one embodiment, any one of a number of different types of aircraft such as, for example, a private propeller or jet engine driven airplane, a commercial jet liner, or a helicopter. In the depicted embodiment, the aircraft 20 includes a flight deck 22 (or cockpit) and a flight system 24, which may jointly form an avionics system from at least some of the components and subsystems described below, as is commonly understood. Although not specifically illustrated, it should be understood that the aircraft 20 also includes a frame or body to which the flight deck 22 and the flight system 24 are connected, as is commonly understood. It should also be noted that aircraft 20 is merely exemplary and could be implemented without one or more of the depicted components, systems, and data sources. It will additionally be appreciated that the aircraft 20 could be implemented with one or more additional components, systems, or data sources.

The flight deck 22 includes a user interface 26, display devices 28, a communications radio 30, a navigational radio 32, an audio device 34, a headset 36, and a head (and/or eye) motion tracker 38.

The user interface 26 is configured to receive input from a user 40 (e.g., a pilot) and, in response to user input, supply command signals to the flight system 24. The user interface 26 may include flight controls (not shown) and any one of, or combination of, various known user interface devices including, but not limited to, a cursor control device (CCD), such as a mouse, a trackball, or joystick, and/or a keyboard, one or more buttons, switches, or knobs. In the depicted embodiment, the user interface 26 includes a CCD 42 and a keyboard 44. The user 40 uses the CCD 42 to, for example, move a cursor symbol on the display devices 28, and use the keyboard 44 to, for example, input textual data.

Still referring to FIG. 1, the display devices 28 are used to display various images and data, in graphic, iconic, and/or textual formats, and to supply visual feedback to the user 40 in response to the user input commands supplied by the user 40 to the user interface 26. It will be appreciated that the display devices 28 may each be implemented using any one of numerous known displays suitable for rendering image and/or text data in a format viewable by the user 40, such as a cathode ray tube (CRT) displays, a LCD (liquid crystal display), or a TFT (thin film transistor) display. The display devices 28 may also be implemented on the flight deck 22 as "head-down" displays or a head-up display (HUD) projection on a fixed image combiner.

The communication radio 30 is used, as is commonly understood, to communicate with entities outside the aircraft 20, such as air-traffic controllers and pilots of other aircraft. The navigational radio 32 is used to receive from outside sources and communicate to the user various types of information regarding the location of the vehicle, such as Global Positioning Satellite (GPS) system and Automatic Direction Finder (ADF) (as described below). The audio device 34 is, in one embodiment, an audio speaker mounted within the flight deck 22.

Figure 2:
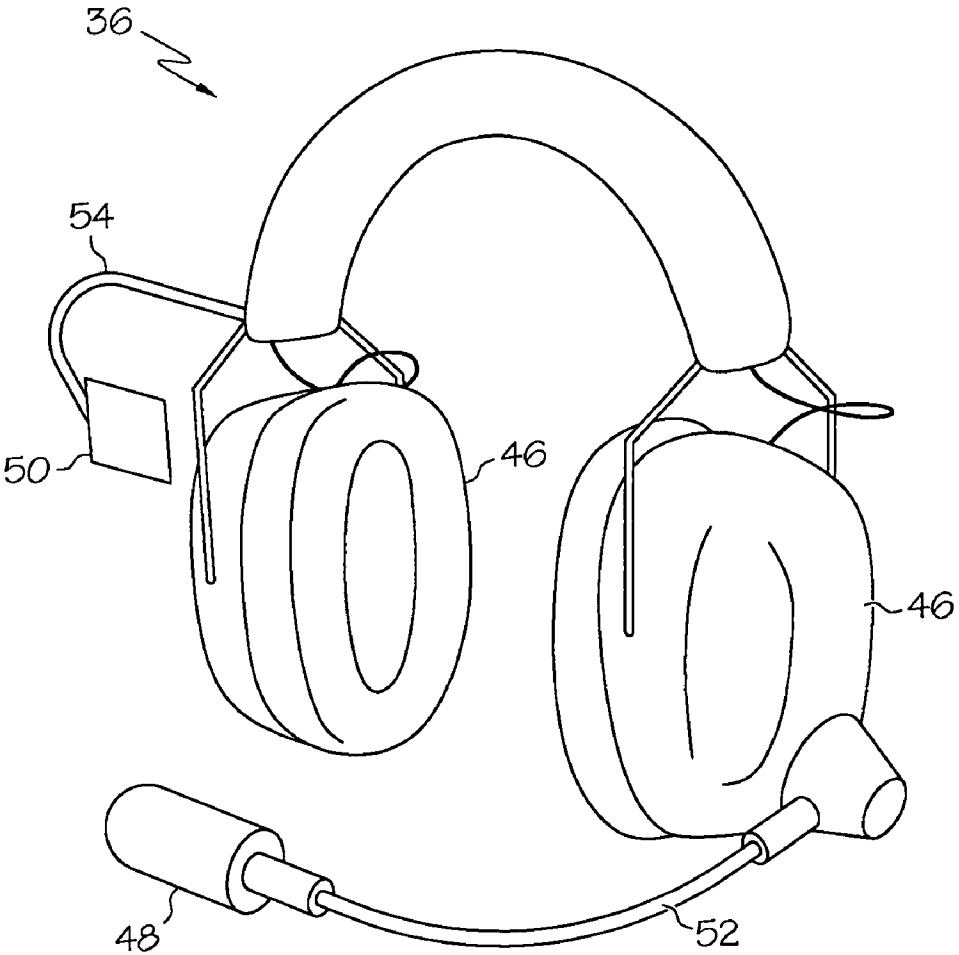
FIG. 2 is an isometric view of a headset including a near-to-eye (NTE) display within the aircraft of FIG. 1, according to one embodiment of the present invention.

Referring to FIG. 2, the headset 36 includes an interconnected combination of earphones 46, a microphone 48, and a near-to-eye (NTE) display (or display screen) 50. The earphones 46 may include a set of speakers (not shown) and substantially form a frame for the headset 36. The earphones 46 (or the frame) may also be configured to be removably worn by the user 40 (e.g., the pilot). The microphone 48 is connected to the earphones 46 by a microphone arm 52. The NTE display 50 may be adjustably suspended from or connected to the earphones 46 by an NTE arm 54 such that the display 50 may be positioned directly in front of an eye of the user 40 while the headset 36 is worn, as is commonly understood. The earphones 46 and the microphone 48 may be in operable communication with the communications radio 30, and the NTE display 50 may be in operable communication with the flight system 24, as described below. In one embodiment, the NTE display 50 is an image combiner (i.e., a substantially transparent plate), as is commonly understood. The NTE display 50 may also be, for example, a flat panel display screen, such as an LCD display screen, and may include optics, such as collimating optics, which affect the focus characteristics of the display.

Referring again to FIG. 1, the motion tracker 38 is configured to detect movements (i.e., position and angular orientation) of the pilot's head, the headset 36 as a whole, and/or the NTE display 50, as is commonly understood.

As shown in FIG. 1, the flight system 24 includes a runway awareness and advisory system (RAAS) 55, an instrument landing system (ILS) 56, a flight director 58, a weather data source 60, a terrain avoidance warning system (TAWS) 62, a traffic and collision avoidance system (TCAS) 64, a plurality of sensors 66 (e.g., a barometric pressure sensor, a thermometer, and a wind speed sensor), one or more terrain databases 68, one or more navigation databases 70, a navigation and control system (or navigation computer) 72, and a processor 74. The various components of the flight system 24 are in operable communication via a data bus 76 (or avionics bus). Although not illustrated, the navigation and control system 72 may include a flight management system (FMS), a control display unit (CDU), an autopilot or automated guidance system, multiple flight control surfaces (e.g., ailerons, elevators, and a rudder), an Air Data Computer (ADC), an altimeter, an Air Data System (ADS), a Global Positioning Satellite (GPS) system, an automatic direction finder (ADF), a compass, at least one engine, and gear (i.e., landing gear).

The processor, or processing system, 74 may be any one of numerous known general-purpose controllers or an application specific processor that operates in response to program instructions, such as field programmable gate arrays (FPGAs), application specific integrated circuits (ASICs), discrete logic, microprocessors, microcontrollers, and digital signal processors (DSPs), or combinations thereof. In the depicted embodiment, the processor 74 includes on-board RAM (random access memory) 78 and on-board ROM (read only memory) 80. The program instructions that control the processor 74 may be stored in either or both the RAM 78 and the ROM 80. For example, the operating system software may be stored in the ROM 80, whereas various operating mode software routines and various operational parameters may be stored in the RAM 78. The RAM 78 and/or the ROM 80 may include instructions stored thereon for carrying out the methods and processes described below. It will be appreciated that this is merely exemplary of one scheme for storing operating system software and software routines, and that various other storage schemes may be implemented. It will also be appreciated that the processor 74 may be implemented using various other circuits, not just a programmable processor. For example, digital logic circuits and analog signal processing circuits could also be used.

During operation of the aircraft 20, the headset 36 is worn by the pilot 40 (or other user), and the earphones 46 and the microphone 48 are used to communicate with ground personnel, as well as other aircraft. Additionally, the NTE display 50 is adjusted such that it is positioned directly in front of one of the user's 40 eyes.

In one embodiment, the pilot 40 is provided with traffic advisory information from, for example, an air traffic controller (ATC) through the communications radio 30. As is commonly understood, the traffic advisory information includes information describing the position and velocity (direction and speed of motion) of another aircraft (i.e., a "traffic aircraft," an aircraft other than the aircraft 20 described above, or the "primary aircraft"). The particular information provided about the traffic aircraft may include a horizontal position (or "bearing") of the traffic aircraft relative to the primary aircraft (e.g., "2 o'clock"), a distance between the primary aircraft and the traffic aircraft, an altitude of the traffic aircraft, a state of change of altitude of the traffic aircraft (e.g., climbing, level, or descending), a heading (i.e., direction of travel) of the traffic aircraft, and a type (e.g., model) of the traffic aircraft. As will appreciated by ones skilled in the art, a speed of the traffic aircraft (e.g., high or low) may be estimated by the pilot 40 based on the type of aircraft (e.g., a jet will be traveling much faster than a single propeller plane).

Figure 3:
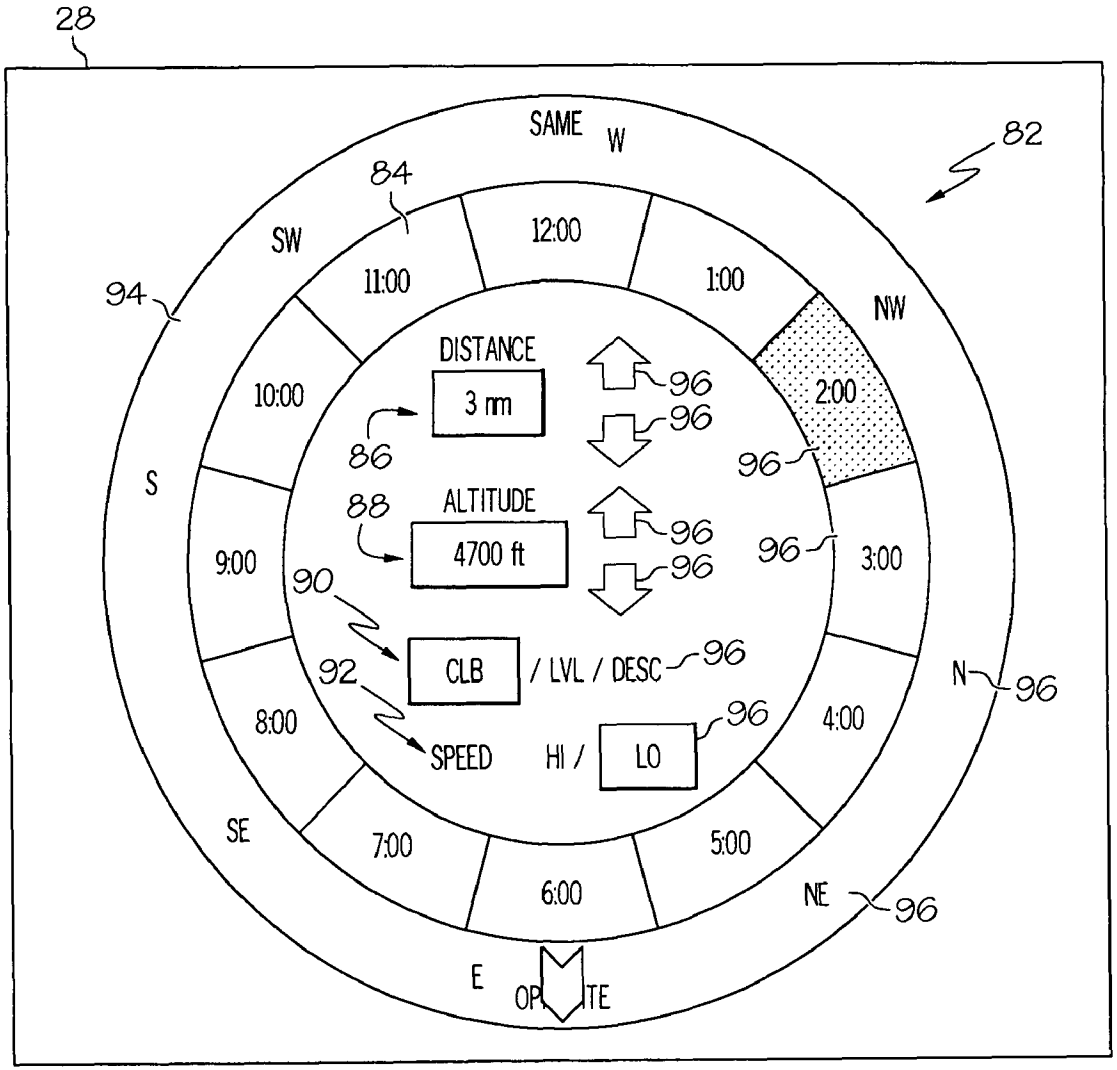
FIG. 3 is a plan view of a display device on-board the aircraft of FIG. 1 displaying a traffic advisory information interface according to one embodiment of the present invention.

According to one aspect of the present invention, the user is provided with an interface for quickly entering, storing, and viewing the traffic advisory information in an intuitive manner. FIG. 3 illustrates one of the display devices 28, during operation of the avionics system according to one embodiment of the present invention. As shown, on the display device 28 a traffic advisory information interface 82 is displayed.

The interface 82 includes a horizontal position indicator 84, a distance indicator 86, an altitude indicator 88, an altitude state of change indicator 90, a speed indicator 92, and a heading indicator 94. In one embodiment, the respective display device 28 includes a contact sensitive surface (e.g., a touch-screen LCD) such that a plurality of "buttons" 96 are formed, at least some of which overlap indicators 84-94. In the depicted embodiment, the horizontal position indicator 84 is substantially ring-shaped and includes various "o'clock" values that overlap with the buttons 96 thereon. As such, upon receiving traffic advisory information, the pilot 40 may select the appropriate "o'clock" value by manually touching (or pressing) the associated button 96. In the example shown, "2 o'clock" has been selected by the pilot 40 and is thus shown on the display device 28 as being highlighted.

In the depicted embodiment, the distance indicator 86, the altitude indicator 88, the altitude state of change indicator 90, and the speed indicator 92 are displayed in a central opening of the horizontal position indicator 84. The distance and altitude indicators 86 and 88 include "value up" and "value down" buttons 96 for adjusting the values displayed, which may be used by the pilot after receiving traffic advisory information. The altitude state of change indicator 90 and the speed indicator 92 each include buttons 96 that overlap with the displayed values such that the pilot 40 may selected the appropriate values by touching the display device 28 at the desired value. For example, if the traffic advisory information reports that the other aircraft is climbing and traveling at a low speed, the pilot 40 may indicate such behavior by touching the appropriate buttons 96 in indicators 90 and 92 as shown in FIG. 3.

The heading indicator 94 is ring-shaped and positioned around a periphery of the horizontal position indicator 84. The heading indicator 94 includes an array of compass readings (e.g., NW) and a plurality of buttons 96 that correspond to the compass readings, as well as "same" and "opposite" buttons 96. The pilot 40 is thus provided with the ability to enter the heading, or course, of the other aircraft upon receiving the traffic advisory information. As will be appreciated by one skilled in the art, in the event that the other aircraft is moving in the same or opposite direction as the primary aircraft, the pilot 40 may select the "same" or "opposite" buttons, as such phraseology is often used in traffic advisories. During flight, the heading indicator 94 and the compass readings and buttons displayed thereon may change in accordance with the heading of the aircraft 20 (i.e., the primary aircraft). That is, the heading indicator not only provides the user with the ability to store the heading of the other aircraft, but also serves as a working compass.

Figure 4:
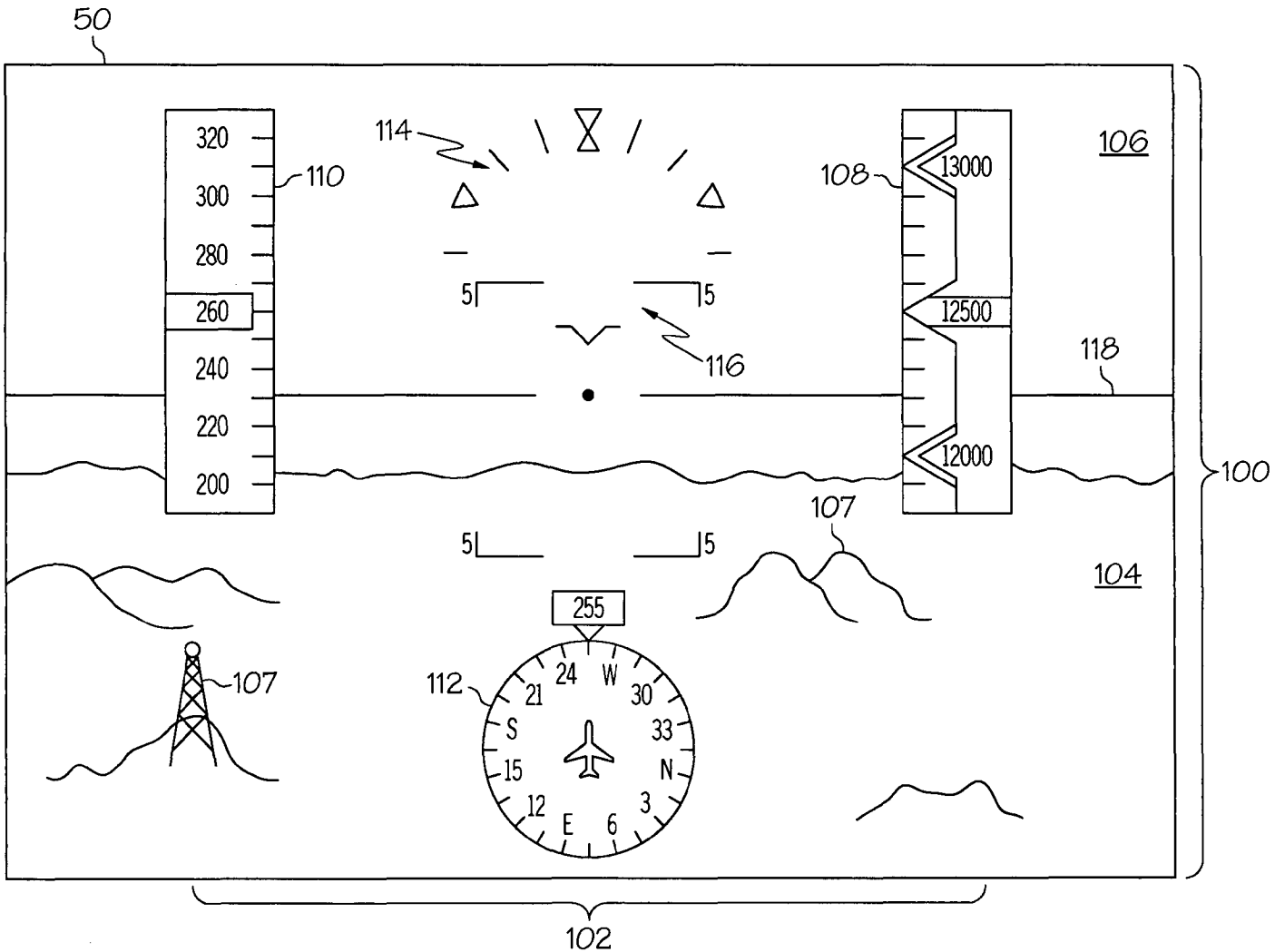
FIGS. 4, 5, 6, are plan views of the NTE display of FIG. 2 illustrating the operation thereof in accordance with an aspect of the present invention.

Referring now to FIG. 4, the operation of the NTE display 50, in accordance with another aspect of the present invention, is displayed. As shown, on the NTE display 50 are displayed a terrain image 100 and a symbology image (or simply "symbology") 102. The terrain image 100 is at least representative of the pilot's view from the flight deck 22. In the exemplary embodiment shown in FIG. 3, the terrain image 100 depicts a perspective view from the aircraft 20 of the terrain outside the aircraft 20 and covers substantially the entire display 50. The terrain image 100 includes a terrain portion 104 and a sky portion 106. As is commonly understood, in an embodiment in which the display 50 is an image combiner, the terrain image 100 is simply the pilot's 40 view of the terrain (and/or the interior of the flight deck 22) as seen through the NTE display 50. In an embodiment in which the NTE display 50 is, for example, an LCD display, the terrain image 100 is generated based on multiple readings from various instruments onboard the aircraft 20 that provide a current position and/or orientation (e.g., heading) of the aircraft 20 and changes as the position and/or orientation of the aircraft 20 changes, as well as the terrain and navigational databases 68 and 70 (FIG. 1). As such, in one embodiment, the terrain image 100 also includes conformal components 117 that, in an embodiment in which the display 50 is a HUD, are shown as to overlay corresponding "real world" components outside the aircraft 20. Examples of conformal components 107 include terrain features (e.g., hills, mountains, valleys, etc.) and landmarks (e.g., runways, radio towers, etc.).

Still referring to FIG. 4, the symbology 102 is displayed over the terrain image 100. The symbology 102 includes multiple digital instruments, such as an altitude indicator 108, an airspeed indicator 110, a heading indicator 112, a roll indicator 114, and a pitch indicator 116. In the embodiment illustrated, the altitude indicator 108 and the airspeed indicator 110 are displayed as an altitude "tape" and an airspeed tape, respectively, as is commonly understood. The heading indicator 112 is graphically displayed as a compass at a lower center portion of the display 50. The roll indicator 114 is displayed above the heading indicator 112 at an upper portion of the display 50, and the pitch indicator 116 is positioned between the heading indicator 112 and the roll indicator 114. The digital instruments 108-116 provide an indication of a position and/or orientation (i.e., heading, pitch, roll, etc.) of the aircraft 20 to the user 40. As shown, the NTE display 50 also includes a horizon bar 118, which may be considered to be part of either the terrain image 100 or the symbology image 102, or alternately part of neither. The horizon bar 118 extends horizontally near the center of the screen 50, through the pitch indicator 116.

As will be appreciated by one skilled in the art, the particular appearance of the terrain image 100 (and perhaps the symbology 102) on the NTE display 50 is dependent upon the spatial coordinates of the NTE display 50 (i.e., the position and angular orientation of the NTE display 50). That is, as the pilot's head moves, the images that should be shown on the NTE display 50 change, particularly the conformal components 107.

Figure 5:
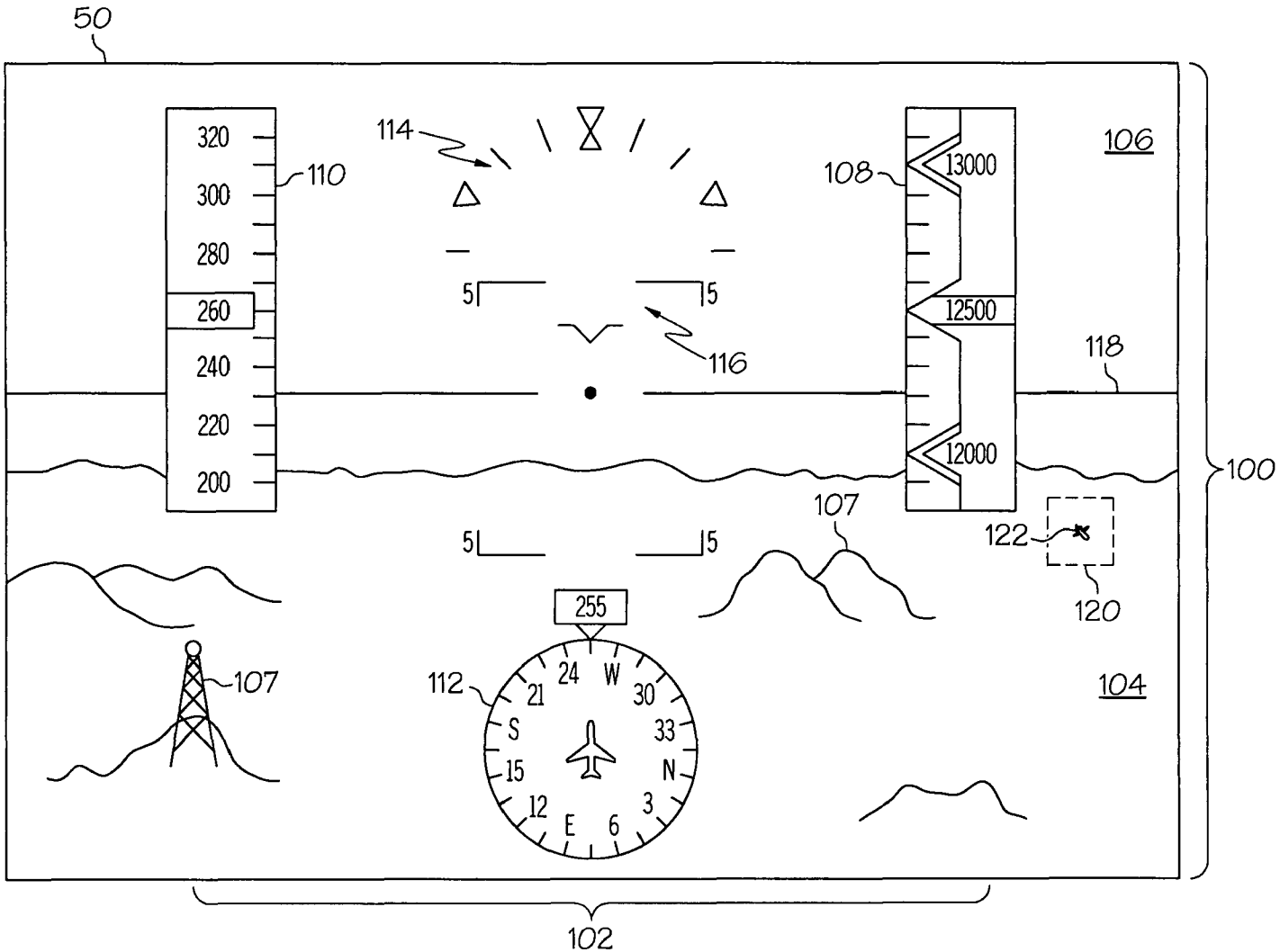

Referring now to FIG. 5, upon receiving the traffic advisory information (e.g., from the display device 28 on which the traffic display interface 82 is displayed), the avionics system (and/or the processor 74) generates a traffic advisory position indicator 120 on the NTE display 50 based on the information represented by the selections made by the user 40 to the interface 82, as well as the known operating conditions of the primary aircraft 20 (e.g., position, heading, altitude, etc.). The result is that the visual indicator is displayed to the user that approximates the position of the traffic aircraft relative to the primary aircraft. That is, the traffic advisory position indicator 120 provides an indication to the user 40 of where the traffic aircraft should be visible. In the depicted embodiment, the traffic advisory position indicator 120 is a dashed box that appears to surround the traffic aircraft 122 (or an image of the traffic aircraft 122).

Figure 6:
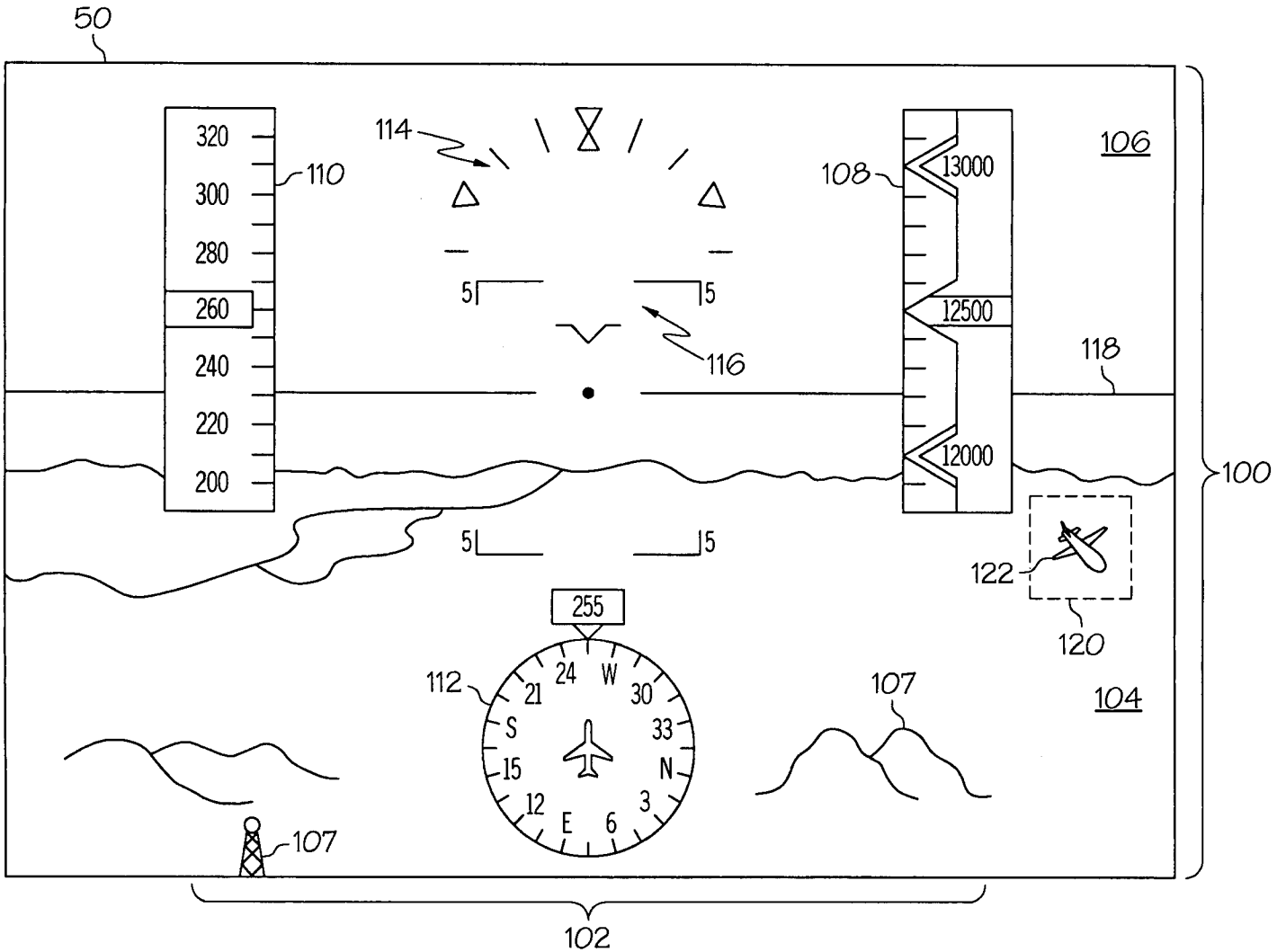

As shown in FIG. 6, the traffic advisory position indicator 120 may be moved based on the traffic advisory information and/or the known operating conditions (e.g., position, heading, altitude, etc.) of the primary aircraft 20. That is, as the primary aircraft 20 and the traffic aircraft 122 move relative to each other, the direction in which the traffic aircraft 122 is visible from the flight deck 22 may change. Thus, a comparison of FIGS. 5 and 6 shows that the traffic advisory position indicator 120 has moved or changed from a first position to a second position (or a first position relative to the primary aircraft to a second position relative to the aircraft).

In an embodiment in which the altering of the traffic advisory position indicator 120 is based on the traffic advisory information (i.e., the position and velocity), as the traffic advisory position indicator 120 is moved to the second position, the intensity in which it is displayed on the NTE display screen 50 may be reduced to indicate a decrease in the level of certainty about the actual position of the traffic aircraft 122. The intensity may continue to be reduced as the traffic advisory position indicator 120 is moved to additional subsequent positions. The size of the traffic advisory position indicator 120 may also be increased to indicate the uncertainty in the actual position of the traffic aircraft 122.

In another embodiment, the altering of the traffic advisory position indicator 120 is performed based on an update to the traffic advisory information. That is, the first position of the traffic advisory position indicator 120 shown in FIG. 5 may be based on a first set of traffic advisory information, for example, as entered by the user 40 into the traffic advisory information interface 82 (FIG. 3), and the second position shown in FIG. 6 may be based on a second set of traffic advisory information entered by the user 40 into the interface 82.

It should be noted that embodiments of the present invention are envisioned in which the traffic advisory position indicator 120 is displayed without requiring the user 40 to manually enter the information. For example, the processor 70 may receive traffic advisory information from, for example, the communications radio 30 or the TCAS system 64 and cause one or more visual indicators of the traffic advisory information to be displayed to the user, such as on one of the display devices 28 (perhaps in a format similar to that of the traffic advisory information interface 82) or on the NTE display 50 in a manner similar to that shown in FIGS. 5 and 6 and described above.

One advantage of the methods and systems described above is the user is provided with a visual indicator of the position of other aircraft. Another advantage is that the traffic advisory information interface provides a simple, intuitive manner for entering, storing, and viewing the traffic advisory information. As a result, in such embodiments, the information may be quickly entered into the avionics system, thus minimizing the time and effort exerted by the pilot on such a task.

The methods and systems described above may be utilized on vehicles other than aircraft, such as land vehicles and watercraft, or in the absence of vehicular platforms. Although one embodiment shown in the drawings incorporates a headset with an NTE display, it should be understood that the methods and system described herein may also be used on other types of HUD devices, such as those utilizing fixed image combiners on the flight deck, as well as those not displaying information conventionally displayed on HUDs (such as described above) but only displaying the visual indicator based on the traffic advisory information. Additionally, it should be understood that the methods and systems may be used in avionics system that do not include advanced display devices. As a simple example, an array of lights could be positioned around the flight deck, one or two of which could be lighted to indicate to the pilot the direction in which the traffic aircraft lies. Another example, a laser pointer could be mounted on the flight deck to, for example, to paint a spot on the windshield (or windscreen) to indicate to the pilot the direction in which the traffic aircraft lies.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for operating an avionics system comprising:

providing, on a display device, a traffic advisory information interface, the traffic advisory information interface comprising a horizontal position interface, a distance interface, and altitude interface, and altitude state of change interface, a speed interface and a heading interface, wherein the heading interface is substantially ring shaped;

the traffic advisory information interface receiving a set of data that is representative of traffic advisory information from a user; and displaying visual indicators to the user based on the set of data the that is representative of the traffic advisory information that the traffic advisory information interface received from the user, wherein the set of data comprises at least one of horizontal position, distance, altitude, altitude state of change, speed, and heading of an aircraft;

the visual indicators indicating a position of a traffic aircraft, a velocity of a traffic aircraft, or a combination thereof, the traffic aircraft being an aircraft other than a primary aircraft in which the avionics system is installed.

2. The method of claim 1, wherein the traffic advisory information is representative of a position of a traffic aircraft, a velocity of a traffic aircraft, or a combination thereof, the traffic aircraft being an aircraft other than a primary aircraft in which the avionics system is installed.

3. The method of claim 2, wherein the visual indicator comprises a horizontal direction indicator that indicates a horizontal position of the traffic aircraft relative to the primary aircraft, a distance indicator that indicates a distance between the primary aircraft and the traffic aircraft, an altitude indicator that indicates an altitude of the traffic aircraft, an altitude change indicator that indicates a state of change of altitude of the traffic aircraft, a speed indicator that indicates a speed of the traffic aircraft, a heading indicator that indicates a heading of the traffic aircraft, or a combination thereof.

4. The method of claim 2, further comprising altering the visual indicator.

5. The method of claim 4, wherein the visual indicator indicates a position of the traffic aircraft relative to the primary aircraft.

6. The method of claim 5, wherein the altering of the visual indicator comprises adjusting the visual indicator from indicating a first position of the traffic aircraft relative to the primary aircraft to a second position of the traffic aircraft relative to primary aircraft.

7. The method of claim 6, wherein the altering of the visual indicator is based on the velocity of the traffic aircraft.

8. The method of claim 6, further comprising receiving a second set of data that is representative of traffic advisory information, and wherein the altering of the visual indicator is based on the second set of data that is representative of traffic advisory information.

9. The method of claim 6, wherein the visual indicator is displayed on a head-up display (HUD) device.

10. The method of claim 9, wherein the HUD device is a near-to-eye (NTE) display device.

11. An avionics system comprising:

a display device, comprising a traffic advisory information interface, the traffic advisory information interface comprising a horizontal position interface, a distance interface, an altitude interface, and altitude state of change interface, a speed interface and a heading interface, wherein the heading interface is substantially ring shaped;

the traffic advisory information interface configured to receive data representative of traffic advisory information from a user, wherein the data comprises at least one of horizontal position, distance, altitude, altitude state of change, speed, and heading of an aircraft;

the traffic advisory information being representative of a position of a traffic aircraft, a velocity of a traffic aircraft, or a combination thereof, the traffic aircraft being an aircraft other than a primary aircraft in which the avionics system is installed;

a visual indicator generator configured to display a visual indicator to the user; and a processing system in operable communication with the receiver and the visual indicator generator, the processing system being configured to cause the visual indicator generator to display a visual indicator to the user based on a set of data that is representative of the traffic advisory information inputted into the traffic advisory information interface by the user.

12. The avionics system of claim 11, wherein the visual indicator comprises a horizontal direction indicator that indicates a horizontal position of the traffic aircraft relative to the primary aircraft, a distance indicator that indicates a distance between the primary aircraft and the traffic aircraft, an altitude indicator that indicates an altitude of the traffic aircraft, an altitude change indicator that indicates a state of change of altitude of the traffic aircraft, a speed indicator that indicates a speed of the traffic aircraft, a heading indicator that indicates a heading of the traffic aircraft, or a combination thereof.

13. The avionics system of claim 11, wherein the processing system is further configured to alter the visual indicator, and wherein the visual indicator indicates a position of the traffic aircraft relative to the primary aircraft.

14. The avionics system of claim 13, wherein the altering of the visual indicator comprises adjusting the visual indicator from indicating a first position of the traffic aircraft relative to the primary aircraft to a second position of the traffic aircraft relative to primary aircraft.

15. The avionics system of claim 14, wherein the altering of the visual indicator is based on the velocity of the traffic aircraft.

16. The avionics system of claim 14, wherein the processing system is further configured to cause the altering of the visual indicator based on a second set of data that is representative of the traffic advisory information received by the receiver.

17. The avionics system of claim 16, wherein the visual indicator generator is a near-to-eye (NTE) head-up display (HUD) device.

18. An avionics system comprising:

a display device, comprising a traffic advisory information interface, the traffic advisory information interface comprising a horizontal position interface, a distance interface, an altitude interface, and altitude sate of change interface, a speed interface and a heading interface, wherein the heading interface is substantially ring shaped;

the traffic advisory information interface configured to receive data representative of traffic advisory information from a user, wherein the data comprises at least one of horizontal position, distance, altitude, altitude state of change, speed, and heading of an aircraft; and a visual indicator generator configured to display a plurality of visual indicators to the user based on traffic advisory information inputted into the traffic advisory information interface by the user, the visual indicators indicating a position of a traffic aircraft, a velocity of a traffic aircraft, or a combination thereof, the traffic aircraft being an aircraft other than a primary aircraft in which the avionics system is installed.

19. The avionics system of claim 18, wherein the plurality of visual indicators comprise two or more of a horizontal direction indicator that indicates a horizontal position of the traffic aircraft relative to the primary aircraft, a distance indicator that indicates a distance between the primary aircraft and the traffic aircraft, an altitude indicator that indicates an altitude of the traffic aircraft, an altitude change indicator that indicates a state of change of altitude of the traffic aircraft, a speed indicator that indicates a speed of the traffic aircraft, a heading indicator that indicates a heading of the traffic aircraft, or a combination thereof.

20. The avionics system of claim 19, wherein the user input device comprises at least one contact sensitive device that overlaps with at least one of the plurality of visual indicators.

* * * * *